US011529008B2

(12) United States Patent
Lee

(10) Patent No.: US 11,529,008 B2
(45) Date of Patent: Dec. 20, 2022

(54) THERMAL BABY FOOD TRAY

(71) Applicant: Eun Heui Lee, Yongin-Si (KR)

(72) Inventor: Eun Heui Lee, Yongin-Si (KR)

( * ) Notice: Subject to any disclaimer, the term of this patent is extended or adjusted under 35 U.S.C. 154(b) by 405 days.

(21) Appl. No.: 16/562,916

(22) Filed: Sep. 6, 2019

(65) Prior Publication Data

US 2020/0093299 A1 Mar. 26, 2020

(51) Int. Cl.

| | |
|---|---|
| ***A47G 19/02*** | (2006.01) |
| ***A45C 11/20*** | (2006.01) |
| ***B65D 1/36*** | (2006.01) |
| ***B65D 43/02*** | (2006.01) |
| ***B65D 81/34*** | (2006.01) |
| *A47G 21/00* | (2006.01) |

(52) U.S. Cl.

CPC ..... *A47G 19/027* (2013.01); *A45C 11/20* (2013.01); *B65D 1/36* (2013.01); *B65D 43/0214* (2013.01); *B65D 81/3476* (2013.01); *A47G 2021/008* (2013.01); *A47G 2200/166* (2013.01); *B65D 2205/02* (2013.01)

(58) Field of Classification Search

CPC ..... A47G 19/027; A47G 2021/008; A47G 2200/166; A45C 11/20; B65D 1/36; B65D 43/0214; B65D 81/3476; B65D 2205/02; A47J 27/004; A47J 36/24; A47J 37/105; A47J 41/0044; A47J 27/21083; A47J 37/0629; A47J 37/0676; A47J 37/1209

See application file for complete search history.

(56) References Cited

U.S. PATENT DOCUMENTS

| | | | | |
|---|---|---|---|---|
| 10,856,687 | B1 * | 12/2020 | Sargent | A47J 36/321 |
| 2003/0192874 | A1 * | 10/2003 | Lerner | F23N 5/24 219/445.1 |
| 2006/0081627 | A1 * | 4/2006 | Shei | A47J 27/004 219/771 |
| 2007/0158327 | A1 * | 7/2007 | Morrow | A47B 77/08 219/385 |
| 2009/0194522 | A1 * | 8/2009 | Connolly | A47J 27/004 219/521 |
| 2016/0324359 | A1 * | 11/2016 | Aboujassoum | A47J 27/08 |
| 2018/0317693 | A1 * | 11/2018 | Huang | A47J 27/086 |
| 2019/0069353 | A1 * | 2/2019 | Hall | A47J 27/004 |

* cited by examiner

*Primary Examiner* — Shawn M Braden

(74) *Attorney, Agent, or Firm* — John K. Park; Park Law Firm

(57) ABSTRACT

Disclosed is a heating food tray for child. The heating food tray for child according to the embodiments of the present invention is provided with a heat generation unit to provide a function of heating food contained in the food tray or keeping a temperature of the food. In addition, the embodiments of the present invention provides the heating food tray including the control unit to execute or stop the heating or heat-keeping function when the temperature deviates from a preset value.

8 Claims, 2 Drawing Sheets

THERMAL BABY FOOD TRAY

CROSS-REFERENCE TO RELATED APPLICATION

This application claims priority to and the benefit of Korean Patent Application No. 10-2018-0106877, filed on Sep. 7, 2018, the entire contents of which are herein incorporate by reference in its entirety.

BACKGROUND OF THE INVENTION

1. Field of the Invention

The present invention relates to a heating food tray for a child, and more particularly, to a heating food tray for a child, which has functions of heating and heat-reserving food, and is controllable to prevent overheating.

2. Description of the Related Art

In general, a child including an infant (hereafter referred to as "child" as a concept including an infant and a child) often uses a food tray for a child at home as well as during a group meal in a daycare center, a kindergarten, or the like. Since children are easily distracted, poor at using chopsticks and spoons, and thus often unable to concentrate on their meals, accordingly a meal time may be expanded. In this regard, Korean Utility Model Publication No. 20-2016-0002088 (entitled "FOOD TRAY FOR INFANT FOR WATCHING SMART PHONE") discloses a food tray for an infant for watching a smart phone in which a smart phone holder formed of a transparent material is provided on a food tray for a child so as to allow the child to concentrate the meal while watching the smart phone, thereby eating the food quickly. However, since the conventional food tray for a child does not have an additional function for heat-reserving or heating, the food on the food tray cools when meal time is prolonged as above, and thus the child may eat the cold food.

(Patent document 1) Korean Utility Model Publication No. 20-2016-0002088 (Published on Jun. 17, 2016)

SUMMARY OF THE INVENTION

The present invention provides a heating food tray for a child, which has a heat-reserving or heating function for maintaining warmth of food during a meal until the child eats the food completely. In addition, the present invention provides a heating food tray for a child, which is controlled to prevent overheating and used safely.

According to an aspect of the present invention, the present invention provides a heating food tray for a child, which includes: a first body including a plurality of first receiving grooves having an upper side opened, and a first flat plate formed to surround upper outer surfaces of the first receiving grooves; a second body formed with a plurality of second receiving grooves coming into close contact with lower portions of the first receiving grooves while accommodating the lower portions, respectively, in which the first body is detachably mounted on an upper portion of the second body; a heat generation unit installed in at least one of the second receiving grooves to heat-reserve or heat food accommodated in the first receiving groove; a control unit accommodated in the second body and configured to allow the heat generation unit to generate heat or stop generating the heat when a temperature of the heat generation unit deviates from a temperature set by a user; and a food tray cover configured to cover an upper portion of the first body, wherein the first body is provided with a first contact sensor configured to detect whether the food tray cover is coupled to the first body, and the second body is provided with a second contact sensor configured to detect whether the first body is coupled to the second body, and a manipulation unit configured to provide an interface for setting a temperature of the heat generation unit and selectively operating the heat generation unit, and wherein the control unit controls the heat generation unit to stop heating or allows the manipulation unit to be inactivated when the first contact sensor detects an uncoupled state between the food tray cover and the first body, or the second contact sensor detects an uncoupled state between the first body and the second body.

According to the heating food tray for a child of the embodiments of the present invention, the heat generation unit is provided, so that a function of heating the food contained in the food tray or a function of heat-reserving to maintain the warmth of the food can be provided, and the control unit is provided, so that the heating food tray can be prevented from overheating and can be used safely.

DETAILED DESCRIPTION OF THE INVENTION

Figure 1:
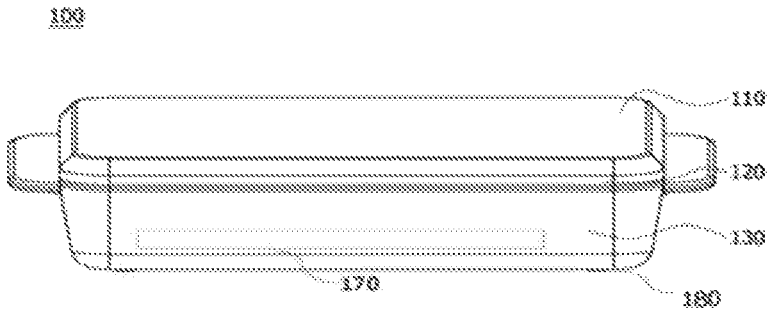
FIG. 1 is a perspective view showing a heating food tray for a child according to one embodiment of the present invention.

Hereinafter, the embodiments of the present invention will be described with reference to the accompanying drawings. The embodiments are provided for the purpose of comprehension of the present invention, and the scope of the present invention is not limited to the embodiments described below. In addition, the embodiments are provided to more completely describe the invention to those having ordinary skills in the art, therefore, the present invention will be defined only by the scope of claims. The same reference numeral indicates the same element throughout the specification.

FIG. 1 is a perspective view showing a heating food tray 100 for a child according to one embodiment of the present invention.

Referring to FIG. 1, the heating food tray 100 includes a first body 120, a second body 130, a heat generation unit (not shown), and a control unit 170, and may further include a food tray cover 110.

A plurality of receiving grooves may be formed in the first body 120, so that food may be accommodated in each of the receiving grooves. The food tray cover 110 may cover an upper portion of the first body 120 to warm the food faster and maintain warmth. The first body 120 may be mounted on an upper portion of the second body 130. The heat generation unit is installed in the second body 130 to generate heat according to a user manipulation through a manipulation unit provided in the second body 130, so that the receiving grooves of the first body 120 mounted on the second body 130 may be heated. The food accommodated in the receiving groove may be heat-reserved or heated depending on the degree of heat generated by the heat generation unit. The control unit 170 is accommodated in the second body 130 to control the heat generation unit. Particularly, when the temperature of the heat generation unit deviates from the temperature set by the user, the control unit 170 may allow the heat generation unit to generate heat or stop generating the heat, and may allow the heat generation unit to stop generating the heat when the food tray cover 110 is not coupled to the first body 120 or the first body 110 is not coupled to the second body 120.

Hereinafter, each configuration will be described in detail.

Figure 2:
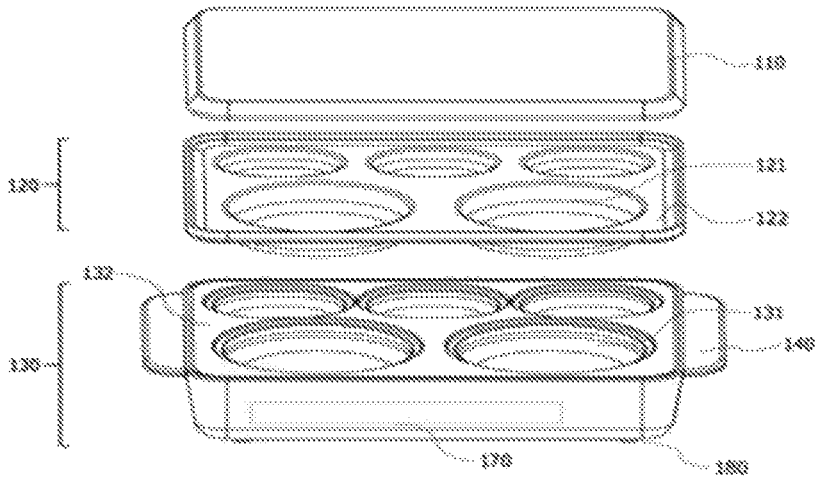
FIG. 2 is an exploded view of FIG. 1.

FIG. 2 is an exploded view of FIG. 1.

Referring to FIG. 2, the first body 120 includes a first receiving groove 121 and a first flat plate 122.

The first body 120 is formed with a plurality of first receiving grooves 121 opened upward to accommodate rice, soup, side dishes, and the like on one surface thereof. In one embodiment, the first receiving groove 121 may include grooves formed at a front of the first body 120 to accommodate rice and soup, and grooves formed at a rear thereof to accommodate side dishes. In one embodiment, a size of the grooves for accommodating the rice and soup may be larger than a size of the grooves for accommodating the side dishes in the first accommodating groove 121. The first flat plate 122 may have a plate shape so as to be gripped by the user. The first receiving groove 121 may be provided at one side of the first flat plate 122, and the first flat plate 122 may be formed to surround an upper outer surface of the first receiving groove 121. A periphery of the first flat plate 122 may be formed at a predetermined interval in the upward direction, so that liquids such as soup may be prevented from flowing out of the first body 120 even when the child spills the liquids during a meal. In addition, the first body 120 may be easily separated from the second body 130 by gripping the periphery of the first flat plate 122.

The first receiving groove 121 and the first flat plate 122 of the first body 120 may be integrated with each other by insert-injection. The first receiving groove 121 and the first flat plate 122 may be formed of materials different from each other. In one embodiment, the first receiving groove 121 may be formed of at least one selected from metal materials such as stainless steel, aluminum, or titanium that has high thermal conductivity to transfer heat to the food accommodated in the first receiving groove 121, and it is not limited to the above-listed materials.

The temperature of the first flat plate 122 may be increased by heat generated when the food accommodated in the first receiving groove 121 is heat-reserved or heated. However, since the first flat plate 122 is a portion with which the child comes into contact during the meal, and the child may be easily burned even by slight heat, the first flat plate 122 may be formed of a material having a low thermal conductivity. Accordingly, the first flat plate 122 may be formed of at least one selected from the group including polypropylene (PP), polycarbonate (PC), polyether sulfone (PES), poly phenylene sulfone (PPSU), and polyamide (PA). Specifically, the material may be PP or PC. PP is lightweight, is strong against a shock and does not leak environmental hormones, thereby being safely used as a material suitable for children. PC is not only strong against heat and shock, but also lightweight and inexpensive, so that costs can be reduced.

The heating food tray 100 for a child may further include a food tray cover 110 for covering the first body 120. One side of the periphery of the first flat plate 122 of the first body 120 may be provided with at least one first magnet, and at least one second magnet may be provided at one side of a lower periphery of the food tray cover 110 to correspond to the first magnet. For example, the first magnet and the second magnet may be permanent magnets. Accordingly, the first magnet and the second magnet are magnetically detachable to each other, so that the food tray cover 110 may cover the first body 120 more stably. Further, even when the food tray cover 110 is smeared by the food or permeated by the food smell, the food tray cover 110 may be easily separated from the first body 120 and washed. The coupling between the first body 120 and the food tray cover 110 is not limited to the magnetic coupling, and any coupling for fixing the food tray cover 110 to the second body 120 is possible. Since the food tray cover 110 is a portion with which the child may come into contact, and the heat of the first body 120 may be transferred during heat-reserving or heating, the food tray cover 110 may be formed of a material having a low thermal conductivity. In one embodiment, the food tray cover 110 may be formed of at least one material selected from the group including PP, PC, PES, PPSU, and PA. Specifically, the material may be PP or PC.

The heating food tray 100 for a child may include the food tray cover 110, so that less external air exerts an influence and thus heat loss and water loss may be minimized, thereby heating the food faster, maintaining warmth of the food longer, and minimizing dryness of the food.

Meanwhile, at least one first contact sensor (not shown) may be provided at one side of the periphery of the first flat plate 122 of the first body 120, and the first contact sensor may detect whether the food tray cover 110 is positioned on the first body 120.

Referring back to FIG. 2, the second body 130 may include a second receiving groove 131, a second flat plate 132, a display window 160, a handle 140, an air vent hole (not shown), a battery (not shown), a power supply terminal (not shown), and an adsorption unit 180.

The second receiving groove 131 and the second flat plate 132 of the second body 130 may be provided such that the second receiving groove 131 is formed on one surface of the second flat plate 132 by insert-injection. An appearance portion defined by the second flat plate 132 and a lower end portion of the second flat plate 132 in the second body 130 may be formed of at least one material selected from the group including PP, PC, PES, PPSU, and PA. Specifically, the material may be PP or PC.

The second body 130 may be detachably coupled to a lower portion of the first body 120, so that a plurality of second receiving grooves 131 may be formed to accommodate the first receiving grooves 121, respectively. The first receiving groove 121 may be accommodated in the second receiving groove 131, and the first flat plate 122 may be supported by the second flat plate 132. In addition, a second contact sensor (not shown) may be provided on one side of an upper portion of the second flat plate 132, and the second contact sensor may detect whether the first body 120 is positioned on an upper portion of the second body 130.

The second receiving groove 131 may be formed to come into close contact with the first receiving groove 121 in order to increase a heat transfer rate from the second receiving groove 131 to the first receiving groove 121 when heat-reserved or heated. In addition, the second body 130 may be magnetically coupled to the first body 120. In one embodiment, at least one third magnet may be provided on one side of the lower portion of the first flat plate 122 of the first body, and at least one fourth magnet may be provided on one side of the upper portion of the second flat plate 132 of the second body 130 so as to correspond to the third magnet. For example, the third magnet and the fourth magnet may be permanent magnets. Accordingly, the first body 120 may be separated from the second body 130 and washed.

The second receiving groove 131 accommodates the first receiving groove 121 so that the heat transferred from the heat generation unit is transferred to the first receiving groove 121, thereby heating the food in the first receiving groove 121. Accordingly, the second receiving groove 131 may be formed of a material having a high thermal conductivity. Specifically, the material may be aluminum, but is not limited thereto.

The heat generation unit may be installed in at least one of the second receiving grooves 131, and may be installed to prevent from being seen from the outside for aesthetics.

The heat generation unit serves to heat-reserve or heat the food accommodated in the first receiving groove 121, may include a heating wire or a ceramic heater, and specifically, may include the ceramic heater. The heat generation unit may be installed to apply heat only to the second receiving groove 131 during the heat-reserving or heating. In one embodiment, when the heat generation unit is a heating wire, the heating wire may be formed to surround an outer surface of the lower portion of the second receiving groove 131. In another embodiment, when the heat generation unit is a ceramic heater, at least one ceramic heater may be installed on a bottom surface of the lower portion of the second receiving groove 131. Specifically, in order to increase the heat transfer rate, the number of ceramic heaters installed on the bottom surface of the lower portion of the second receiving groove 131 may be changed according to an area of the second receiving groove 131 corresponding to the first receiving groove 121. More specifically, when the area of the second receiving groove 131 increases, the number of ceramic heaters installed on the bottom surface of the lower portion of the second receiving groove 131 may increase.

The heat generation unit is provided on one side thereof with a temperature sensor (not shown), and the temperature sensor may detect the temperature of the heat generation unit.

Meanwhile, the handle 140 may be formed on at least one surface of the second body 130 to facilitate movements of the heating food tray 100 for a child. If necessary, the handle 140 may be coupled to a separate support configured to accommodate the second body 130 so as to be detachable with the second body 130.

A plurality of air vent holes (not shown) may be spaced apart from each other at a predetermined interval on at least one side of the outer surface of the second body 130. The heat generated by the heat generation unit may be discharged to the outside, so that the second body 130 may be prevented from overheating. Due to the overheat prevention, a lifespan of the heating food tray 100 for a child may be expanded. The air vent hole may be a hole having various shapes that can release the heat generated by the heat generation unit to the outside, and the shape is not limited in particular.

The second body 130 may be provided therein with a battery (not shown). In one embodiment, the battery may be a rechargeable battery, so that the heating food tray 100 may use the function of heat-reserving or heating for a predetermined time without separate external power supply when being supplied and charged with power. Accordingly, the heating food tray 100 may be carried and used at a place in which the separate external power is not supplied. The power supply terminal (not shown) may be formed at one side of the outer surface of the second body 130. The power supply terminal is configured to receive power from an external power supply device to supply the power to the battery. Accordingly, the heating food tray 100 may be used in a state in which the external power is supplied by connecting the power supply terminal with the external power supply device, or may be used without being connected with the separate external power supply after the battery is charged. The power supply terminal may have various shapes which are already known, and the shape is not limited in particular.

The adsorption unit 180 may be formed at the lower portion of the second body 130. The adsorption unit 180 is configured to prevent a slip and may have various shapes which are already known.

Figure 3:
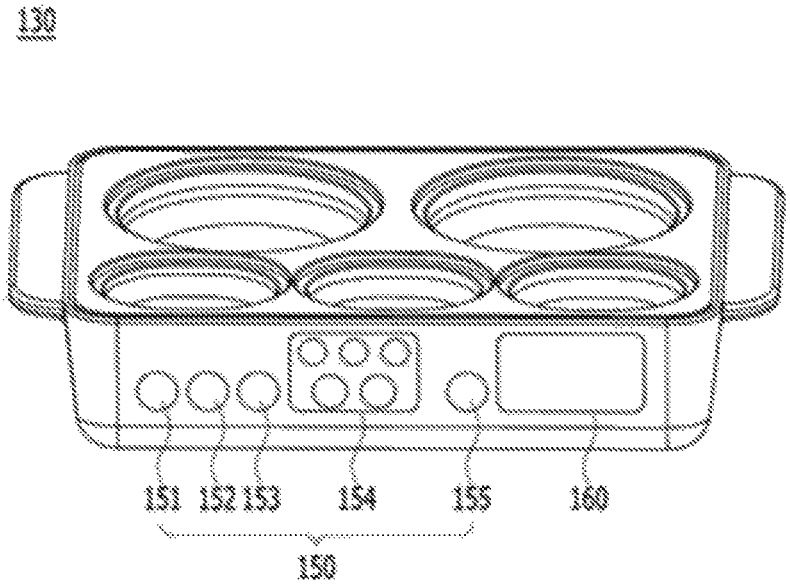
FIG. 3 is a view showing a rear side of a heating food tray for a child according to one embodiment of the present invention.

FIG. 3 is a view showing a rear side of the heating food tray 100 for a child according to one embodiment of the present invention.

Referring to FIG. 3, the manipulation unit 150 may be provided on one surface of the rear side of the second body 130. Accordingly since the child cannot perform any additional manipulation during the meal, the child may have a meal more safely.

The manipulation unit 150 is configured to provide an interface for setting the temperature of the heat generation unit and operating the heat generation unit selectively, and includes a power supply unit 151, a heat reserving unit 152, a heating unit 153, a food tray selection unit 154, and a start unit 155.

The power supply unit 151 may be in the form of a button to turn on/off the power supplied to the second body 130. In one embodiment, when the second body 130 is in a turned-off state, the power may be supplied to the second body 130 when the power supply unit 151 is pressed once, and the power supplied to the second body 130 may be cut off when the power supply unit 151 is pressed again. The power supply unit 151 is not limited to the shape of the button, and any shape for turning on/off the power is possible.

The heat-reserving unit is an interface for heating the heat generation unit at a first predetermined temperature to heat-reserve the food. For example, the first temperature may be 40° C. to 50° C. The heat-reserving unit 152 is configured to set the temperature of the heat generation unit to be the first temperature, and may be manipulated by a user's touch, but is not limited thereto. In one embodiment, the heat-reserving unit 152 may be set to increase the temperature to 40° C., 45° C., and 50° C. by 5° C. for each time the user presses the heat-reserving unit 152. The heat-reserving unit 152 may be set to 40° C. when pressed again, and thus the temperature may be repeated in the range from 40° C. to 50° C. The heat is transferred to the second receiving groove 131 by the heat generation unit according to the setting of the heat-reserving unit 152, and the heat is transferred to the first receiving groove 121 coupled to the second receiving groove 131, so that the warmth of the food contained in the first receiving groove 121 may be maintained. Accordingly, even when the meal time is expanded, the child may eat the warm food.

The heating unit 153 is an interface for heating the heat generation unit to a second temperature preset to heat the food. For example, the second temperature is about 60° C., and the second temperature may have a value higher than the first temperature. The heating unit 153 is configured to set the temperature of the heating unit to be the second temperature, and may be manipulated by the user's touch, but is not limited thereto. When the user presses the heating unit 153, the heat is transferred to the second receiving groove 131 by the heat generation unit, and the heat is transferred to the first receiving groove 121 coupled to the second receiving groove 131, so that the food contained in the first receiving groove 121 may be heated. Accordingly even when the food cools, the food may be easily and conveniently heated.

The food tray selection unit 154 may be manipulated by the user's touch so as to select a receiving groove among the first storage grooves 121 to heat-reserve or heat the food, but is not limited thereto. Since the heating food tray 100 may heat-warm or heat only the receiving groove selected by the food tray selection unit 154 among the first storage grooves 121, the child can eat only the wanted food among rice, soup, and side dishes. In addition, when cold foods such as fruits and salads are contained, the child may eat the cold food in a fresh state together with the warm food unless the groove accommodating the cold food is selected.

The start unit 155 allows the condition set in the heat-reserving unit 152 or the heating unit 153 to be executed. In one embodiment, the heat-reserving is executed when the desired temperature is set in the heat-reserving unit 152 and the start unit 155 is pressed. The heating is executed when the heating unit 153 is pressed and the start unit 155 is pressed. Accordingly, even when the heat-reserving unit 152 or the heating unit 153 is pressed by careless behavior of the child, the heating food tray can be used safely since the heat-reserving or heating is not executed unless the starter 155 is pressed.

The display window 160 is a window that displays a value set from the control unit and a current status, and displays the temperature set by the heat-reserving unit 152 or the heating unit 153, a current temperature after the setting, an occurring time after the setting, a warning sign, and the like, so that the user may check the time required to reach the set temperature, the temperature being raised, the warning sign, and the like.

Figure 4:
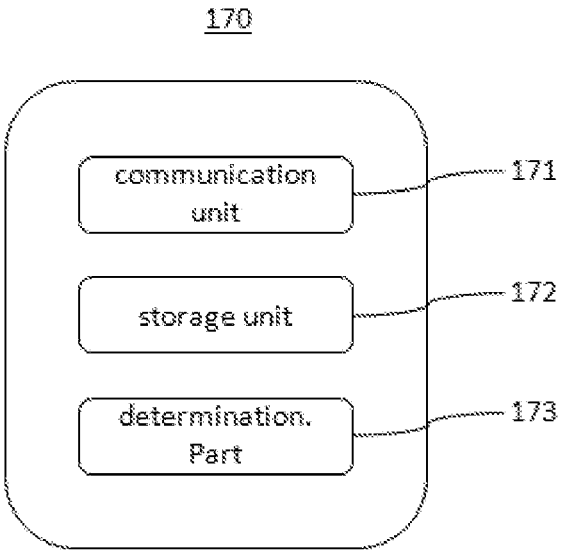
FIG. 4 is a conceptual diagram showing a control unit of a heating food tray for a child according to one embodiment of the present invention.

FIG. 4 is a conceptual diagram showing the control unit 170 of the heating food tray for a child according to one embodiment of the present invention.

Referring to FIG. 4, the control unit 170 is configured to be accommodated in the second body 130 to control the heating food tray 100 as a whole, and includes a communication unit 171, a storage unit 172, and a determination unit 173.

The communication unit 171 receives the temperature set by the manipulation unit 150 and signals detected from the first contact sensor, the second contact sensor, and the temperature sensor, and transmits the signals to the determination unit 173.

The storage unit 172 stores information received from the communication unit 171 and the preset value (the temperature set by the manipulation unit and/or information on a coupling state of the food tray cover, the first body, and the second body).

The determination unit 173 may compare the preset value with the current state stored in the storage unit 172, and may determine and execute to take a predetermined action when the current state deviates from the preset value. In one embodiment, when the detected temperature is lower than the preset value, the heat-reserving or heating function continues. When the detected temperature is higher than the preset value, it is determined to stop the heat-reserving or heating function stops, so that the power supplied to the heat generation unit may be cut off. Accordingly, when the temperature of the heat generation unit reaches the preset value of the manipulation unit 150 and the temperature decreases after a predetermined time, the determination unit 173 compares the temperature with the preset value stored in the storage unit 172 and determines that the temperature has deviated from the preset value, thereby allowing the heat-reserving to be executed. Accordingly, when the above process is repeated, the heat-reserving is maintained, so that the child can eat the warm food even when the meal time is prolonged. In addition, the above process prevents the overheating, so that the heating food tray 100 can be used safely.

In another embodiment, when the signals are not received from the first contact sensor and/or the second contact sensor, the determination unit 173 may determine that the food tray cover 110, the first body 120 or the like is not accurately coupled, thereby allowing the heat-reserving or heating function to be inactivated. Specifically, when no signal is received from the first contact sensor and/or the second contact sensor, the warning sign may be indicated on the display window 160, and the control unit may be inactivated. Although the technical idea of the present invention has been described in detail, it will be apparent that a person having ordinary skill in the art may carry out various modifications such as simple changes of design, omissions of some components, and simple changes of use according to the specific application of the technology within the scope without departing from the idea of the present invention, and such modifications are included in the scope of the present invention.

What is claimed is:

1. A heating food tray for a child, the heating food tray comprising:

a first body including a plurality of first receiving grooves having an upper side opened, and a first flat plate configured to surround upper outer surfaces of the first receiving grooves;

a second body formed with a plurality of second receiving grooves coming into close contact with lower portions of the first receiving grooves while accommodating the lower portions, respectively, in which the first body is detachably mounted on an upper portion of the second body;

a heat generation unit installed in at least one of the second receiving grooves to keep a temperature of food accommodated in the first receiving groove or to heat the food;

a control unit accommodated in the second body and configured to operate the heat generation unit or stop the operation of the heat generation unit when a temperature of the heat generation unit deviates from a temperature set by a user; and a food tray cover configured to cover an upper portion of the first body, wherein the first body is provided with a first contact sensor configured to detect whether the food tray cover is coupled to the first body, and the second body is provided with a second contact sensor configured to detect whether the first body is coupled to the second body, and a manipulation unit configured to provide an interface for setting a temperature of the heat generation unit and selectively operating the heat generation unit, and wherein the control unit controls the heat generation unit to stop the operation of the heat generation unit or controls the manipulation unit to stop the operation of the manipulation unit when the first contact sensor detects that the food tray cover is not coupled to the first body, or when the second contact sensor detects that the first body is not coupled to the second body.

2. The heating food tray of claim 1, wherein the first receiving groove is formed of metal, and the first flat plate is formed of at least one selected from the group consisting of polypropylene (PP), polycarbonate (PC), polyether sulfone (PES), poly phenylene sulfone (PPSU), and polyamide (PA).

3. The heating food tray of claim 1, wherein the first body, the second body, and the food tray cover are provided with at least one magnet, respectively.

4. The heating food tray of claim 3, wherein the heat generation unit is provided at one side thereof with a temperature sensor, and the control unit includes:

a communication unit configured to receive a temperature set by a manipulation unit and signals detected from the first contact sensor, the second contact sensor, and the temperature sensor and transmit the temperature and the signals;

a storage unit configured to store information received from the communication unit and a preset value including the temperature set by the manipulation unit and/or information on a coupling state of the food tray cover, the first body, and the second body; and a determination unit configured to compare the preset value stored in the storage unit with a current state and determine and execute to take a predetermined action when the current state deviates from the preset value.

5. The heating food tray of claim 4, wherein the second body includes an air vent hole configured to discharge the heat generated by the heat generation unit to the outside.

6. The heating food tray of claim 5, wherein the manipulation unit includes:

a heat-reserving unit configured to allow the heat generation unit to generate heat at a predetermined first temperature to keep a temperature of the food;

a heating unit for heating the food with a second temperature which is preset for heating the food and higher than the first temperature; and a food tray selection unit configured to provide an interface for selecting the first receiving groove to be heated.

7. The heating food tray of claim 6, wherein the second body further includes an adsorption unit formed in a lower portion of the second body to prevent the second body from slipping on a bottom.

8. The heating food tray of claim 7, wherein the control unit is configured to receive temperature information from the temperature sensor, and operates or stop the operation of the heat generation unit when the temperature information deviates from the first temperature or the second temperature set in the manipulation unit.

* * * * *